US010030370B1

(12) United States Patent
Xiao et al.

(10) Patent No.: US 10,030,370 B1
(45) Date of Patent: Jul. 24, 2018

(54) TOP MOUNTING FAUCET ASSEMBLY

(71) Applicant: Globe Union Industrial Corp., Taichung (TW)

(72) Inventors: Yueping Xiao, Shen Zen (CN); Tachun Chang, Taichung (TW); Ziqiang Zhou, Shen Zen (CN)

(73) Assignee: Globe Union Industries Corp., Taichung (TW)

( * ) Notice: Subject to any disclaimer, the term of this patent is extended or adjusted under 35 U.S.C. 154(b) by 0 days.

(21) Appl. No.: 15/705,322

(22) Filed: Sep. 15, 2017

(51) Int. Cl.
*E03C 1/04* (2006.01)

(52) U.S. Cl.
CPC .... *E03C 1/0402* (2013.01); *E03C 2001/0416* (2013.01)

(58) Field of Classification Search
CPC ..... E03C 1/0401; E03C 1/0402; E03C 2001/0416
USPC ..... 4/675, 676, 678
See application file for complete search history.

(56) References Cited

U.S. PATENT DOCUMENTS 4,848,395 A * 7/1989 Krippendorf ..... E03C 1/0401 4/676
5,535,776 A 7/1996 Kingman et al.
2014/0075667 A1* 3/2014 Li ..... E03C 1/0402 4/677

* cited by examiner

*Primary Examiner* — Tuan N Nguyen
(74) *Attorney, Agent, or Firm* — Alan D. Kamrath; Kamrath IP Lawfirm, P.A.

(57) ABSTRACT

A top mounting faucet assembly is mounted on a kitchen basin having an opening and contains: a fixer, a body, and a locking bolt. The fixer includes a base and a clamper, wherein the base includes a support portion and an insertion portion, and the support portion includes a peripheral fence and a shoulder, the peripheral fence has a recessed portion and a first anti-rotation portion, the shoulder has two longitudinal holes, and the insertion portion has a cylindrical fence and two columns. The clamper contains two screw rods and two locking protrusions. The body includes a second anti-rotation portion and a threaded orifice. The locking bolt screws with the threaded orifice of the body and abuts against the recessed portion of the base so that the body is stopped and does not move along the base, hence the body does not upwardly remove from the base.

15 Claims, 11 Drawing Sheets

TOP MOUNTING FAUCET ASSEMBLY

FIELD OF THE INVENTION

The present invention relates to a top mounting faucet assembly which is mounted on and is removed from a kitchen basin easily and quickly.

BACKGROUND OF THE INVENTION

A conventional top mounting faucet is mounted on a kitchen basin of a sink.

U.S. Pat. No. 5,535,776 discloses that a device for the top mounting of a faucet to a sink includes a generally cylindrical sleeve having a threaded shank with an internal diameter of a size to receive the body of a faucet and the water connections thereto. The sleeve has an outwardly extending shoulder at one end and an upstanding wall at the extremity of the shoulder. The shoulder is formed and adapted to seat upon the top of a sink. Beneath the sink the shank of the sleeve carries an elastomeric washer which is positioned adjacent the bottom of the sink, a hard washer positioned adjacent the elastomeric washer, and a nut which is threaded onto the shank. The nut urges the hard washer against the seal washer and the seal washer in turn forms a seal with the bottom of the sink. However, many components are fixed under a limited space of the kitchen basin.

U.S. Pat. No. 9,051,719 discloses that a fixing structure of a faucet is mounted on a sink countertop with an opening and contains a base including a supporting portion and an inserting portion. A supporting portion has an annular fence and an annular shoulder; the annular fence has a retaining recess; the annular shoulder has two longitudinally through holes and an opening. The inserting portion has a cylindrical fence and two stopping rods, and the cylindrical fence has a longitudinal channel; the annular shoulder has an annular abutting area. A locking assembly includes two positioning screws and two clamping blocks. A faucet includes a fitting tube, a sheath having a groove, a peripheral fence, and a threaded orifice. A controlling valve assembly is mounted on the fitting tube. A fastening bolt is screwed with the threaded orifice so as to retain with the retaining recess, thus fixing the faucet on the base. Nevertheless, when the sheath does not align with the base, the fastening bolt does not retain with the retaining recess. In addition, the fastening bolt is loose after a period of using time, hence the faucet is not fixed securely.

The present invention has arisen to mitigate and/or obviate the afore-described disadvantages.

SUMMARY OF THE INVENTION

The primary objective of the present invention is to provide a top mounting faucet assembly which is mounted on a kitchen basin easily, quickly, and securely.

Another objective of the present invention is to provide a top mounting faucet assembly which is removed from the kitchen basin quickly.

To obtain the above objectives, a top mounting faucet assembly provided by the present invention is mounted on a kitchen basin having an opening, and the top mounting faucet assembly contains: a fixer, a body, and a locking bolt.

The fixer includes a base and a clamper.

The base includes a support portion and an insertion portion integrally connecting with the support portion, and the support portion includes a peripheral fence and a shoulder connecting with an inner wall of the peripheral fence, wherein the peripheral fence has a recessed portion and a first anti-rotation portion which are individually arranged on two predetermined positions of the peripheral fence. The shoulder has two longitudinal holes passing therethrough. The insertion portion has a cylindrical fence extending downwardly from a bottom of the shoulder, and the insertion portion has two columns arranged on an outer wall of the cylindrical fence.

The clamper contains two screw rods and two locking protrusions, the two screw rods rotatably insert through the two longitudinal holes of the base respectively, and the two locking protrusions screw with the two screw rods individually so that when the two screw rods rotate, the two columns of the base limit upward rotation of the two screw rods, and the two locking protrusions engage with a part of the kitchen basin around the opening.

The body includes a second anti-rotation portion adjacent to a bottom of an inner wall of the body, when the body is fitted with the support portion of the base, the second anti-rotation portion connects with the first anti-rotation portion of the base so that the body is stopped and does not rotate along the base. The body includes a threaded orifice formed on an outer wall thereof adjacent to a bottom of the body.

The locking bolt screws with the threaded orifice of the body and abuts against the recessed portion of the base so that the body is stopped and does not move along the base, hence the body does not upwardly remove from the base.

The recessed portion of the base has a tilted face defined on an upper end of the peripheral fence.

The first anti-rotation portion has multiple toothed racks extending along the peripheral fence.

The second anti-rotation portion has multiple internal faces defined thereon and has a plurality of toothed slots formed on the second anti-rotation portion so that the multiple toothed racks mesh with the plurality of toothed slots respectively.

A vertical length of the first anti-rotation portion along the peripheral fence is less than a vertical length of the second anti-rotation portion.

The recessed portion of the base partially extends around the peripheral fence so that the multiple toothed racks of the first anti-rotation portion mesh with the plurality of toothed slots of the second anti-rotation portion respectively, and the locking bolt abuts against the recessed portion.

The first anti-rotation portion has multiple internal faces defined thereon and has a plurality of toothed slots formed on the first anti-rotation portion.

The second anti-rotation portion has multiple toothed racks extending along the peripheral fence.

A vertical length of the second anti-rotation portion along the peripheral fence is less than a vertical length of the first anti-rotation portion.

The recessed portion of the base partially extends around the peripheral fence so that the multiple toothed racks of the second anti-rotation portion mesh with the plurality of toothed slots of the first anti-rotation portion respectively, and the locking bolt abuts against the recessed portion.

The two columns of the base are integrally connected on the cylindrical fence.

The support portion of the base has a surrounding rib proximate to a bottom of an outer inner wall of the peripheral fence, and the body has a contacting fringe formed on the bottom of the inner wall thereof, such that when the body is secured on the base, the contacting fringe of the body matingly contacts with the surrounding rib.

The clamper includes two positioning bushings screwing with the two screw rods respectively so as to stop a removal of the two locking protrusions from the two screw rods.

The support portion of the base has a marking zone.

The cylindrical fence of the base has a first passage and a second passage which does not communicate with the first passage.

DETAILED DESCRIPTION OF THE PREFERRED EMBODIMENTS

Figure 1:
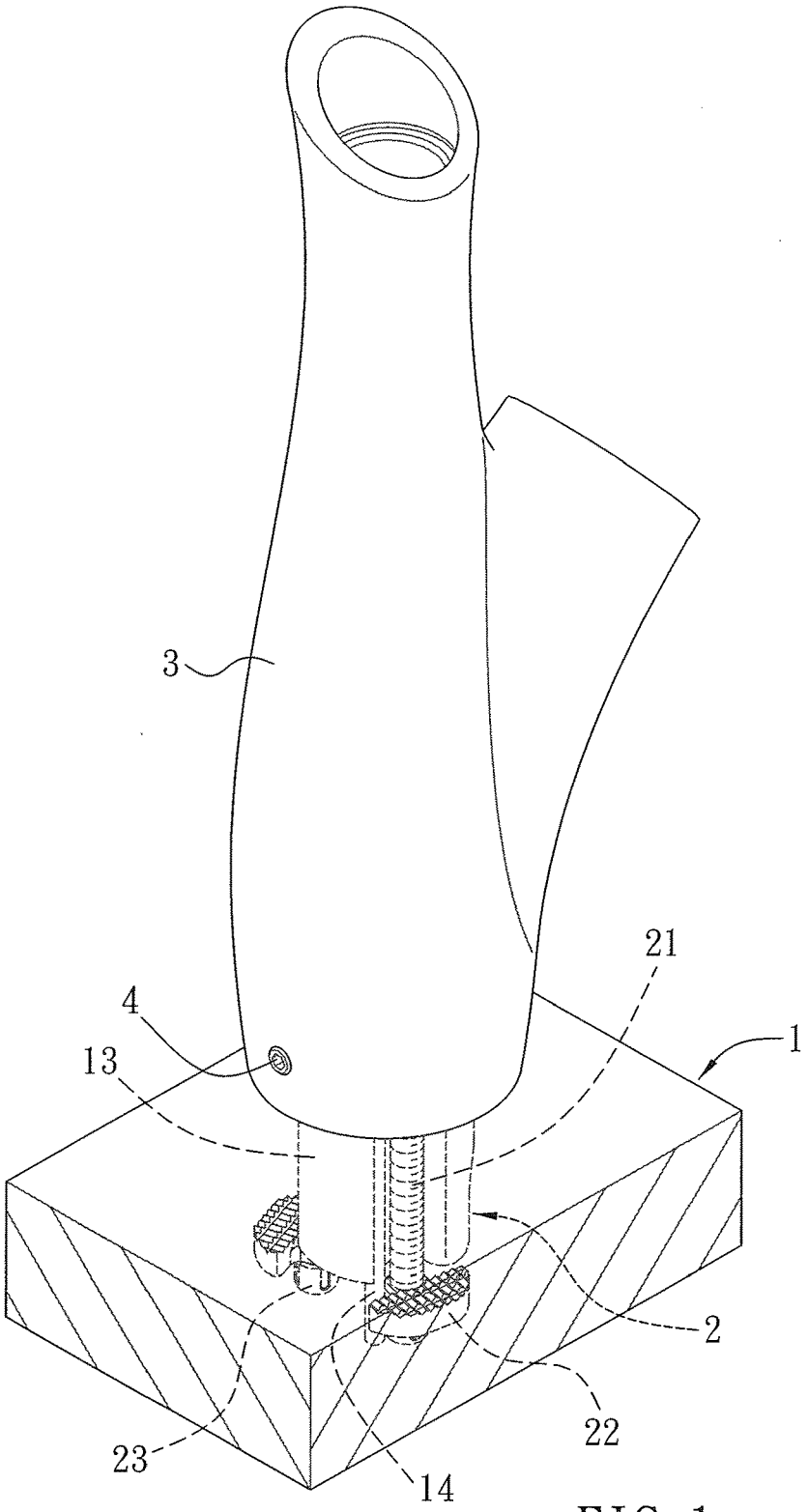
FIG. 1 is a perspective view showing the assembly of a top mounting faucet assembly according to a preferred embodiment of the present invention.
Figure 2:
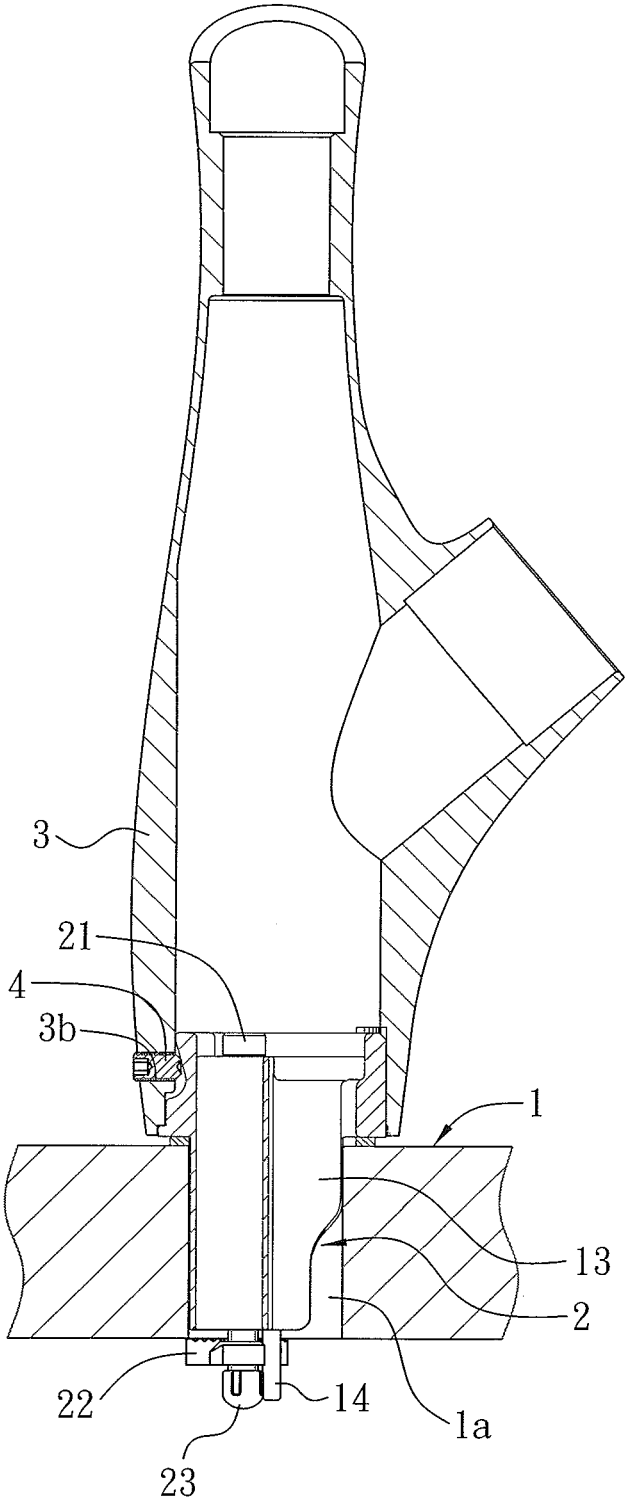
FIG. 2 is a cross sectional view showing the assembly of a part of the top mounting faucet assembly according to the preferred embodiment of the present invention.
Figure 3:
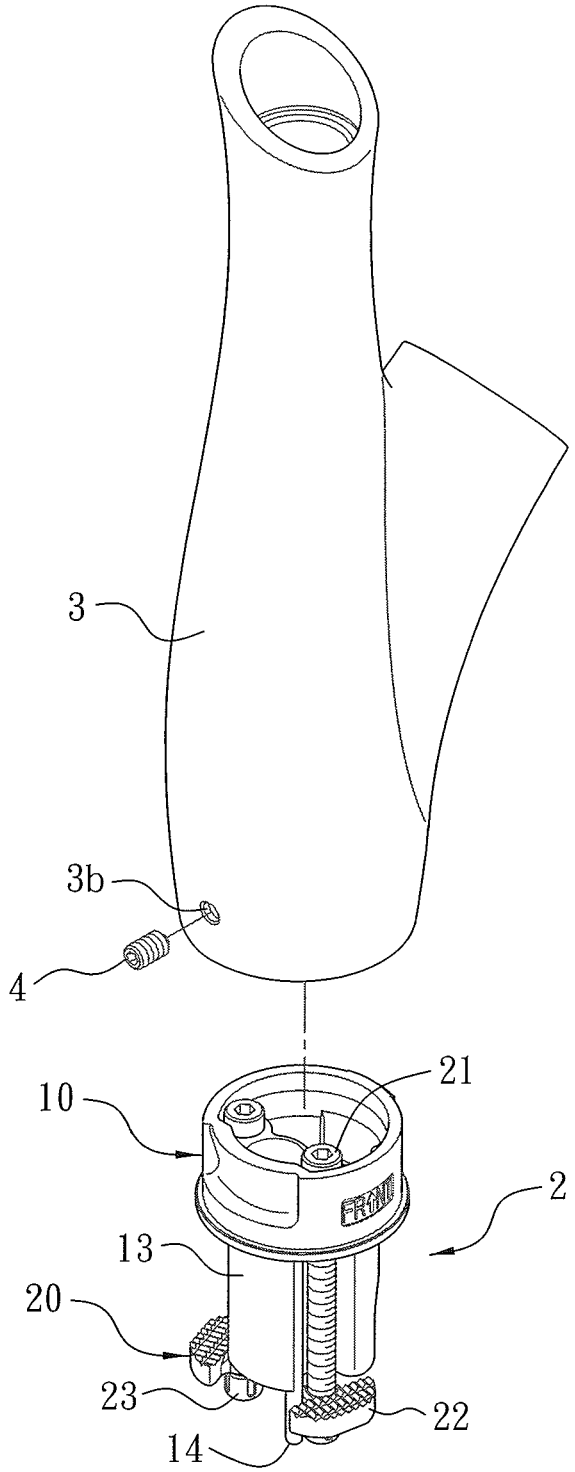
FIG. 3 is a perspective view showing the exploded components of a part of the top mounting faucet assembly according to the preferred embodiment of the present invention.

With reference to FIGS. 1-3, a top mounting faucet assembly according to a preferred embodiment of the present invention is mounted on a kitchen basin 1 having an opening 1*a*, and the kitchen basin 1 is formed by a top plate of a kitchen cabinet on which a sink is arranged, hence the top mounting faucet assembly is mounted on the kitchen basin 1 of the sink.

The top mounting faucet assembly comprises a fixer 2, a body 3, and a locking bolt 4. The fixer 2 includes a base 10 and a clamper 20.

As shown in FIGS. 4-9, the base 10 includes a support portion 10*a* and an insertion portion 10*b* integrally connecting with the support portion 10*a*. The support portion 10*a* includes a peripheral fence 11 and a shoulder 12 connecting with an inner wall of the peripheral fence 11, wherein the peripheral fence 11 has a recessed portion 111 and a first anti-rotation portion 112 which are individually arranged on two predetermined positions of the peripheral fence 11, and the shoulder 12 has two longitudinal holes 121 passing therethrough. The insertion portion 10*b* has a cylindrical fence 13 extending downwardly from a bottom of the shoulder 12, and the insertion portion 10*b* has two columns 14 arranged on an outer wall of the cylindrical fence 13, the cylindrical fence 13 has a first passage 15 and a second passage 16 which does not communicate with the first passage 15.

Figure 7:
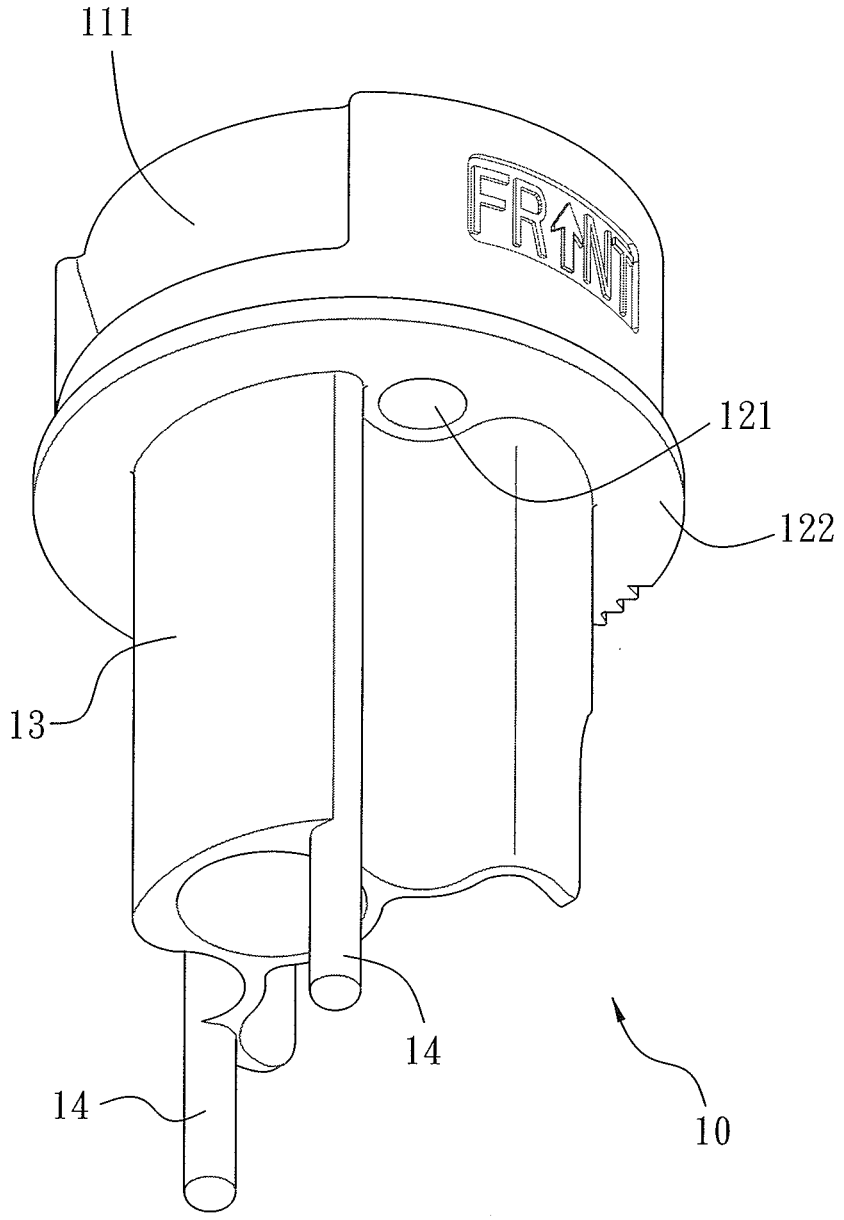
FIG. 7 is also another perspective view showing the assembly of a part of the top mounting faucet assembly according to the preferred embodiment of the present invention.
Figure 8:
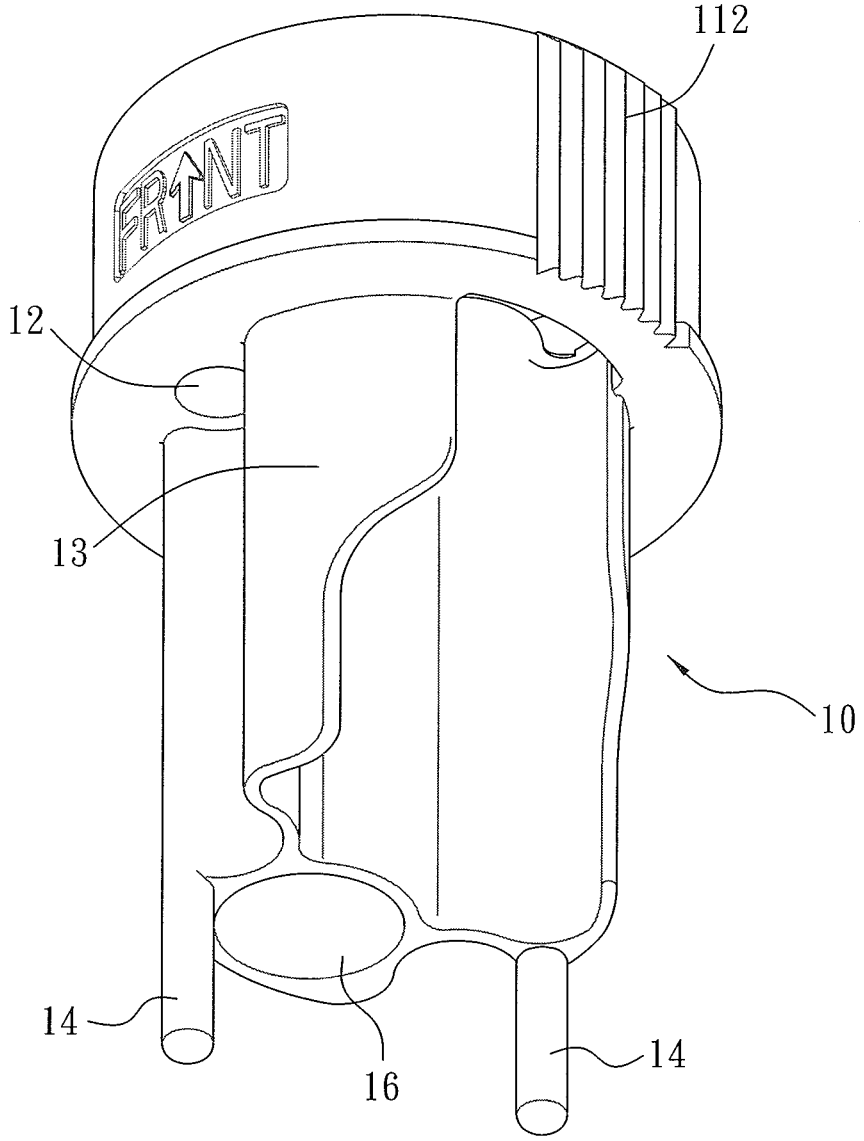
FIG. 8 is still another perspective view showing the assembly of a part of the top mounting faucet assembly according to the preferred embodiment of the present invention.

The shoulder 12 has a circular abutting area 122 defined around the cylindrical fence 13, as illustrated in FIG. 7. When the insertion portion 10*b* of the base 10 inserts through the kitchen basin 1 from the opening 1*a*, as shown in FIG. 2, the circular abutting area 122 contacts with the opening 1*a* of the kitchen basin 1 so that the support portion 10*a* of the base 10 is supported on the kitchen basin 1. It is to be noted that the two longitudinal holes 121 are located outside the circular abutting area 122.

Figure 4:
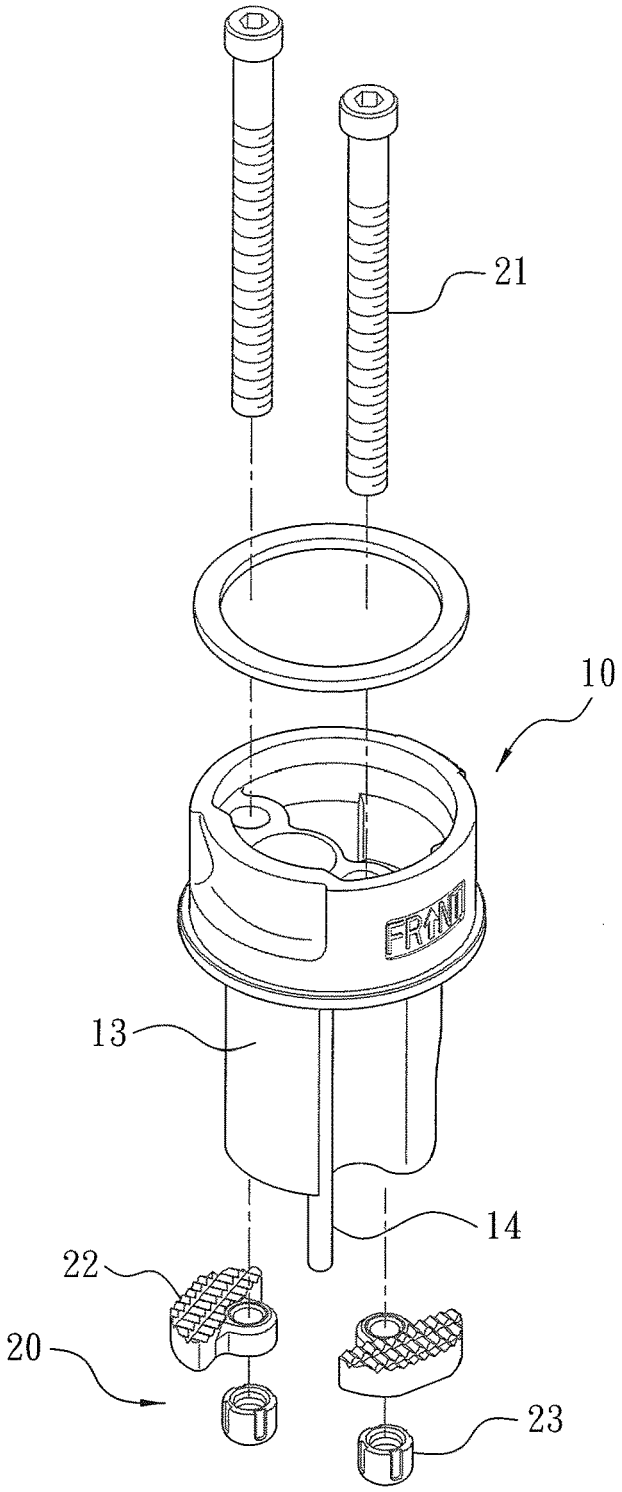
FIG. 4 is another perspective view showing the exploded components of a part of the top mounting faucet assembly according to the preferred embodiment of the present invention.

The clamper 20 is comprised of two screw rods 21 and two locking protrusions 22, as illustrated in FIG. 4, wherein the two screw rods 21 rotatably insert through the two longitudinal holes 121 of the base 10 respectively. Since the two longitudinal holes 121 are located outside the circular abutting area 122, the two screw rods 21 rotatably insert through the two longitudinal holes 121 and do not interfere the opening 1*a* of the kitchen basin 1.

The two locking protrusions 22 screw with the two screw rods 21 individually so that when the two screw rods 21 rotate, the two columns 14 of the base 10 limit upward rotation of the two screw rods 21, and the two locking protrusions 22 engage with a part of the kitchen basin 1 around the opening 1*a*, thus clamping the base 10 on the kitchen basin 1.

Figure 10:
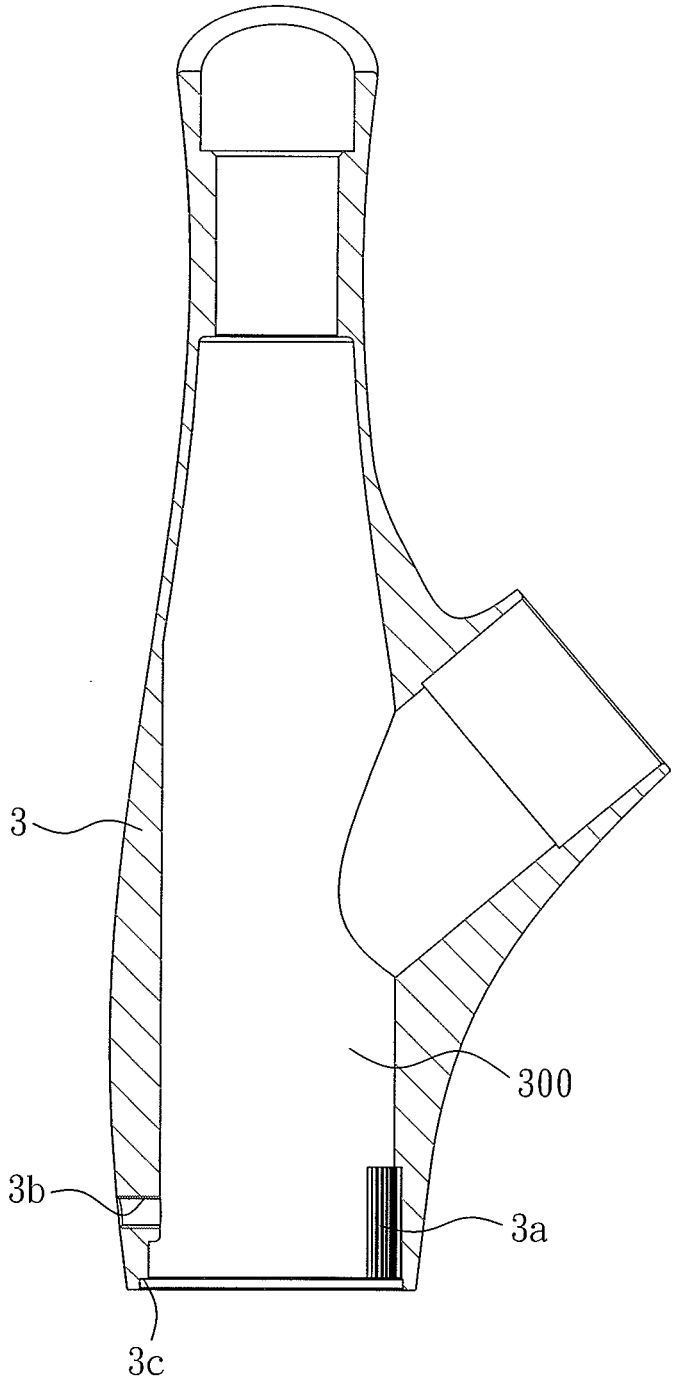
FIG. 10 is a cross sectional view showing the assembly of a part of the top mounting faucet assembly according to the preferred embodiment of the present invention.

Referring to FIGS. 2, 3 and 10, the body 3 is a hollow shell and accommodates a mixing valve (not shown) so that a cold-water tube (not shown) and a hot-water tube (not shown) upwardly extend to connect with the mixing valve on which a supply hose having a counterweight is connected, wherein the supply hose is in connection with a water supply segment of the body 10, and the water supply segment of the body 10 has a shower or a spray head fixed thereon. Due to the supply hose, the supply hose, the shower, and the spray head are well-known art, further remarks are omitted.

With reference to FIG. 10, the body 3 includes a second anti-rotation portion 3*a* adjacent to a bottom of an inner wall of the body 3, wherein when the body 3 is fitted with the support portion 10*a* of the base 10, the second anti-rotation portion 3*a* connects with the first anti-rotation portion 112 of the base 10 so that the body 3 is stopped and does not rotate along the base 10. The body 3 includes a threaded orifice 3*b* formed on an outer wall thereof adjacent to a bottom of the body 3.

Figure 11:
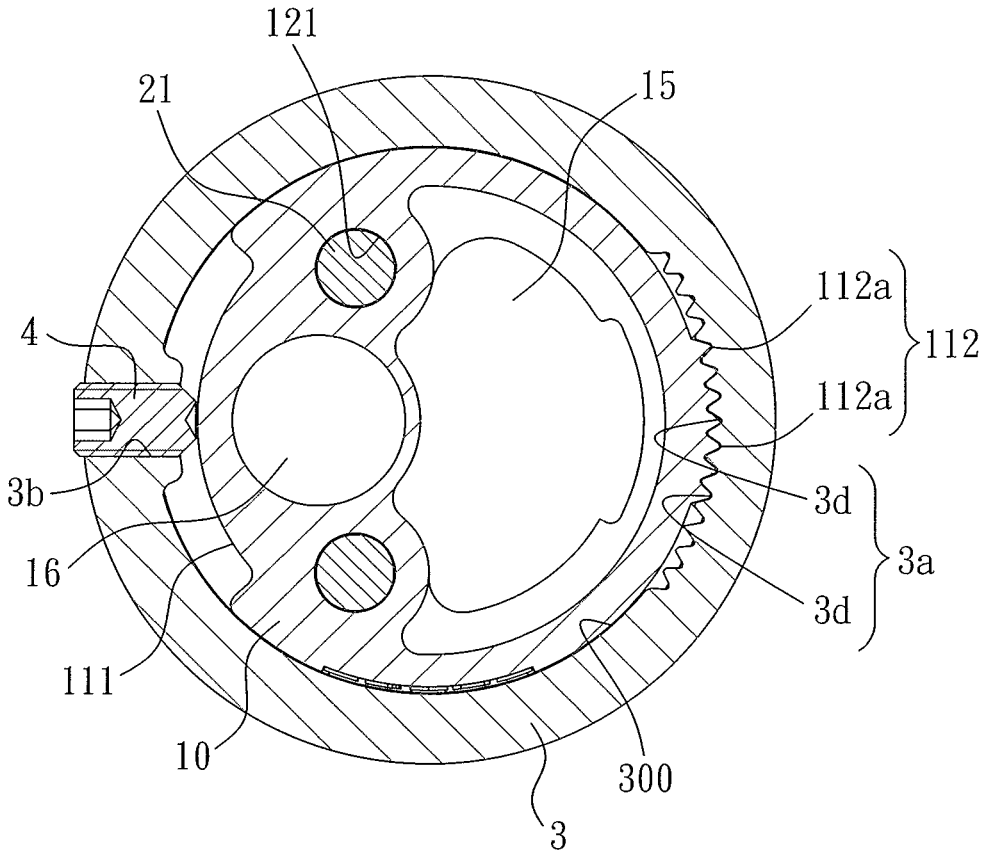
FIG. 11 is a cross sectional view showing the operation of a part of the top mounting faucet assembly according to the preferred embodiment of the present invention.

Referring to FIGS. 2 and 11, the locking bolt 4 screws with the threaded orifice 3*b* of the body 3 and abuts against the recessed portion 111 of the base 10 so that the body 3 is stopped and does not move along the base 10, hence the body 3 does not upwardly remove from the base 10.

Figure 9:
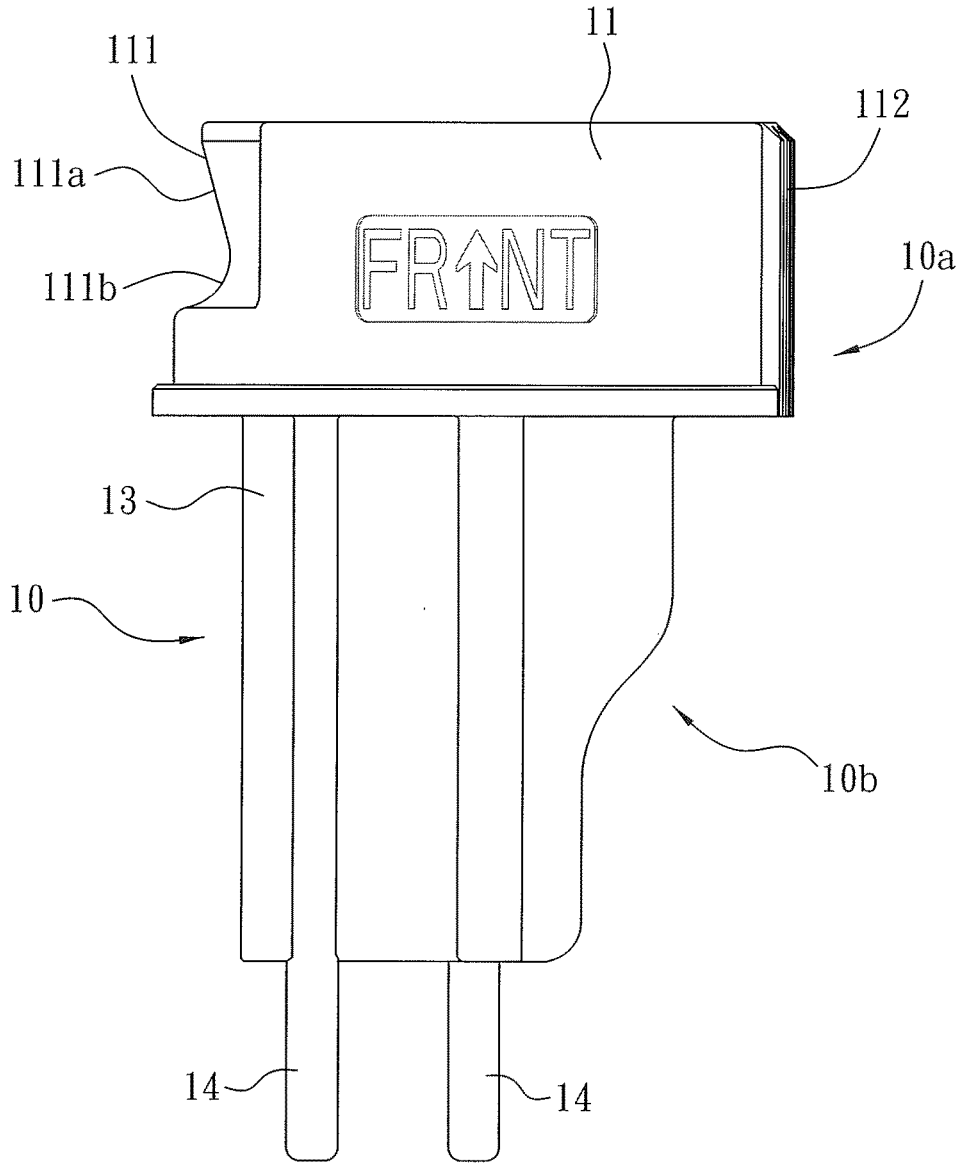
FIG. 9 is a side plan view showing the assembly of a part of the top mounting faucet assembly according to the preferred embodiment of the present invention.

As illustrated in FIG. 9, the recessed portion 111 of the base 10 has a tilted face 111*a* defined on an upper end of the peripheral fence 11 and has an inward concave face 111*b* extending downwardly from the tilted face 111*a*, such that when a distal end of the locking bolt 4 contacts with the tilted face 111*a*, the body 3 is forced to move downwardly.

The first anti-rotation portion 112 of the base 10 has multiple toothed racks 112*a* extending along the peripheral fence 11, the second anti-rotation portion 3*a* of the body 3 has multiple internal faces 300 defined thereon and has a plurality of toothed slots 3*d* formed on the second anti-rotation portion 3*a* so that the multiple toothed racks 112*a* mesh with the plurality of toothed slots 3*d* respectively, hence the body 3 moves longitudinally along the base 10 and does not rotate along the base 10.

A vertical length of the first anti-rotation portion 112 along the peripheral fence 11 is less than a vertical length of the second anti-rotation portion 3*a*. The first anti-rotation portion 112 has seven toothed racks 112*a* extending along the peripheral fence 11, and the second anti-rotation portion 3*a* has fifteen toothed slots 3*d*, hence the seven toothed racks 112*a* mesh with seven of the fifteen toothed slots 3*d* respectively, and the body 3 is in connection with the base 10 easily and quickly.

Preferably, the recessed portion 111 of the base 10 partially extends around the peripheral fence 11 so that the multiple toothed racks 112*a* of the first anti-rotation portion 112 mesh with the plurality of toothed slots 3*d* of the second anti-rotation portion 3*a* respectively, and the locking bolt 4 abuts against the recessed portion 111.

In case a part of the multiple toothed racks 112*a* is located outside the second anti-rotation portion 3*a*, they are stopped by the multiple internal faces 300 of the body 3 so that the locking bolt 4 is not located outside the recessed portion 111.

Preferably, the first anti-rotation portion 112 and the second anti-rotation portion 3*a* are replaceable by each other.

The two columns 14 of the base 10 are integrally connected on the cylindrical fence 13.

Figure 5:
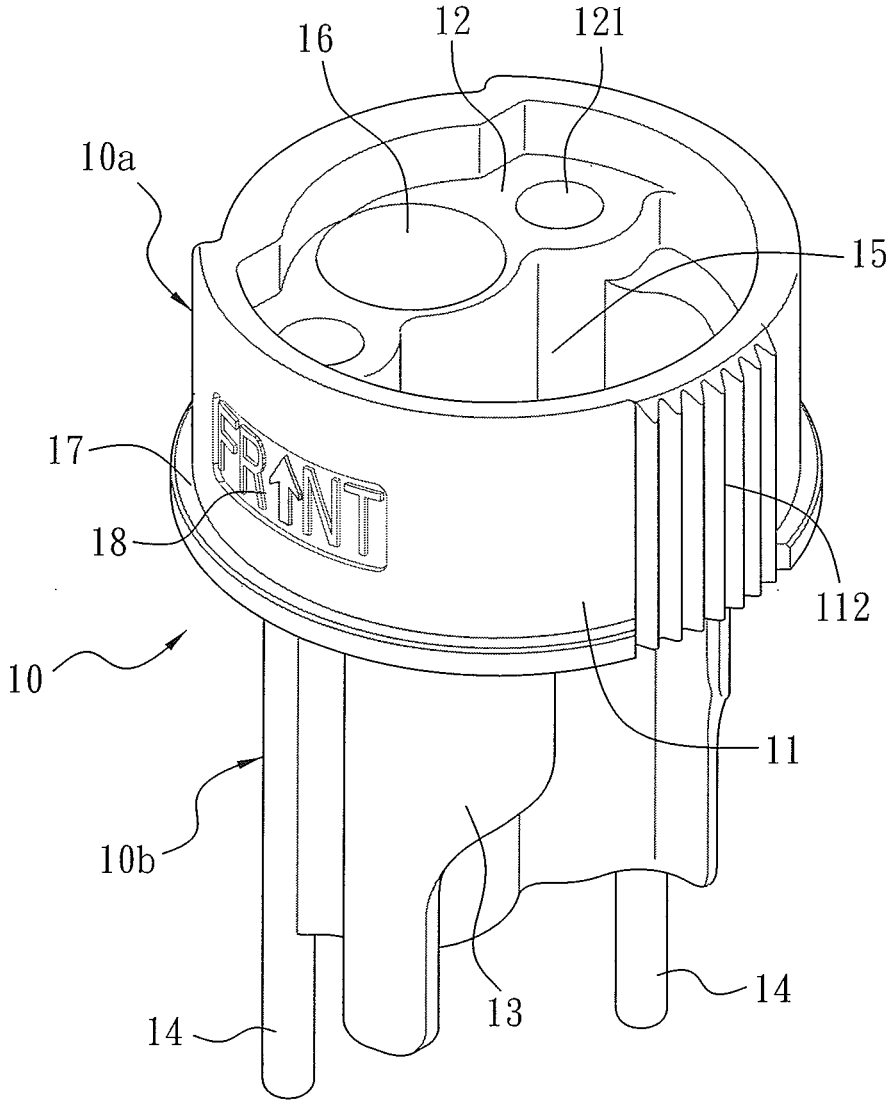
FIG. 5 is a perspective view showing the assembly of a part of the top mounting faucet assembly according to the preferred embodiment of the present invention.
Figure 6:
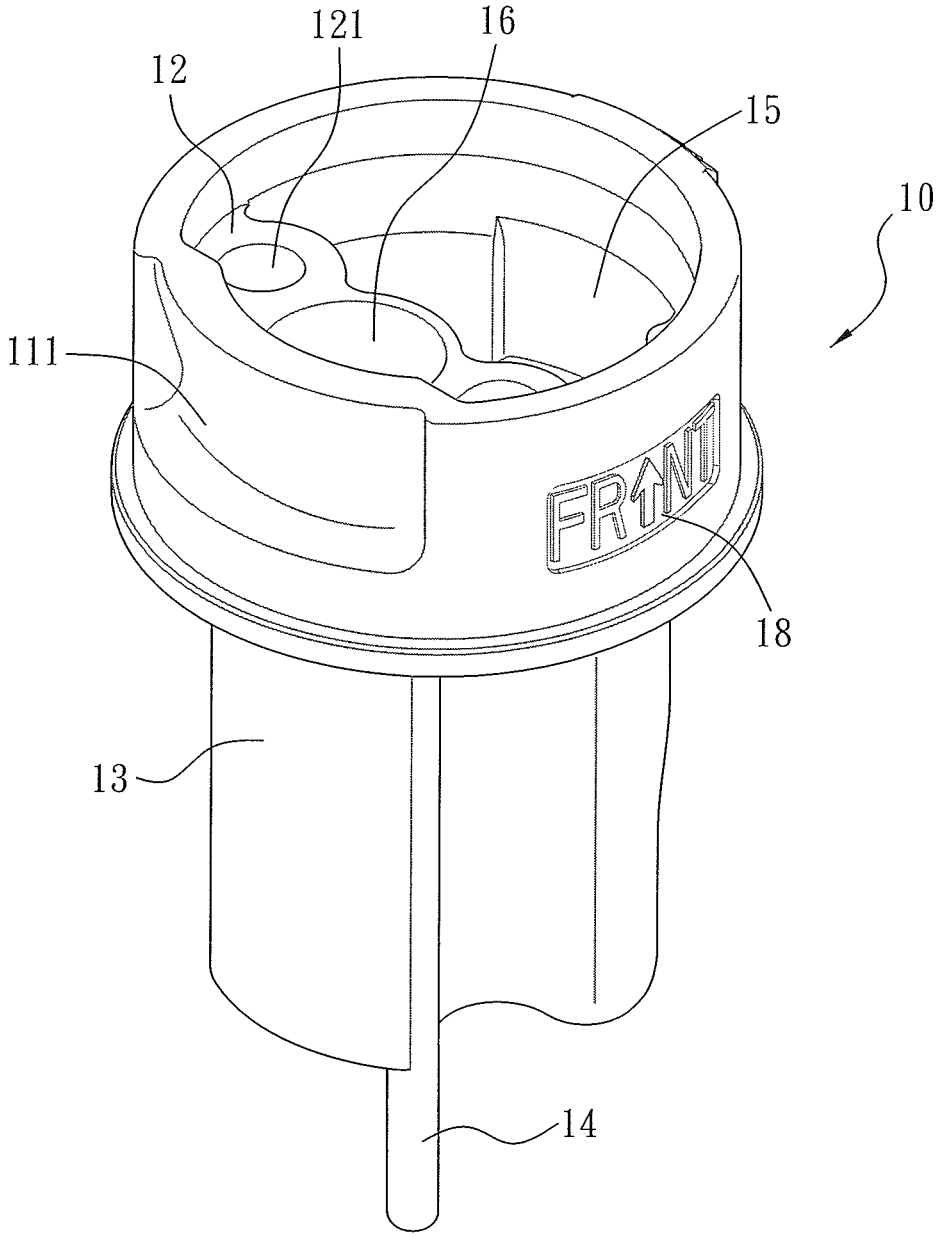
FIG. 6 is another perspective view showing the assembly of a part of the top mounting faucet assembly according to the preferred embodiment of the present invention.

As illustrated in FIGS. 4-5, the support portion 10*a* of the base 10 has a surrounding rib 17 proximate to a bottom of an outer inner wall of the peripheral fence 11. With reference to FIG. 10, the body 3 has a contacting fringe 3*c* formed on the bottom of the inner wall thereof, such that when the body 3 is secured on the base 10 and screws with the locking bolt 4, the contacting fringe 3*c* of the body 3 is forced to matingly contact with the surrounding rib 17 so that the body 3 is fixed securely, and the contacting fringe 3*c* of the body 3 matingly engages with the surrounding rib 17 of the base 10 to avoid water leakage from the body 3.

The support portion 10*a* of the base 10 has a marking zone 18 in which English letters and an arrow are formed, hence a connection direction is distinguishable, as illustrated in FIG. 4. For example, after the base 10 is mounted on the kitchen basin 1 by way of the marking zone 18, the body 3 is installed on an exact position.

The clamper 20 includes two positioning bushings 23 screwing with the two screw rods 21 respectively so as to stop a removal of the two locking protrusions 22 from the two screw rods 21.

In assembly, the base 10 is mounted on the kitchen basin 1, the clamper 20 is positioned on the base 10, and the two locking protrusions 22 are adjustably fixed at a desired angle in a specific direction so that the shoulder 12 of the base 10 and the two locking protrusions 22 and the two screw rods 21 of the clamper 20 are inserted through the kitchen basin 1 from the opening 1*a*.

Then, the two screw rods 21 of the clamper 20 are rotated by using a tool so that the two locking protrusions 22 are limited by the two columns 14 to clamp around the opening 1*a* of the kitchen basin 1, and the base 10 is secured on the kitchen basin 1 by ways of the clamper 20.

Thereafter, the body 3 is fitted on the support portion 10*a* of the base 10 so that the second anti-rotation portion 3*a* connects with the first anti-rotation portion 112, and the multiple toothed racks 112*a* of the first anti-rotation portion 112 mesh with the plurality of toothed slots 3*d* of the second anti-rotation portion 3*a* respectively, as shown in FIGS. 2 and 11, hence a rotation of the body 3 is limited. Preferably, when the contacting fringe 3*c* of the body 3 matingly engages with the surrounding rib 17 of the base 10, the locking bolt 4 screws with the threaded orifice 3*b* of the body 3 and abuts against the recessed portion 111 of the base 10 until the distal end of the locking bolt 4 contacts with the recessed portion 111 of the base 10, and the contacting fringe 3*c* matingly engages with the surrounding rib 17, thus connecting the body 3 with the base 10.

As removing the body 3 from the base 10, the locking bolt 4 is unscrewed so as to maintain or replace the body 3 easily.

Accordingly, the top mounting faucet assembly is fixed on and is removed from the kitchen basin 1 easily and quickly.

In case the locking bolt 4 is loose, the body 3 is still mounted on the base 10 fixedly.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A top mounting faucet assembly being mounted on a kitchen basin having an opening, and the top mounting faucet assembly comprising:

a fixer, a body, and a locking bolt;

the fixer including a base and a clamper;

wherein the base includes a support portion and an insertion portion integrally connecting with the support portion, and the support portion includes a peripheral fence and a shoulder connecting with an inner wall of the peripheral fence, wherein the peripheral fence has a recessed portion and a first anti-rotation portion which are individually arranged on two predetermined positions of the peripheral fence; and the shoulder has two longitudinal holes passing therethrough; the insertion portion has a cylindrical fence extending downwardly from a bottom of the shoulder, and the insertion portion has two columns arranged on an outer wall of the cylindrical fence;

wherein the clamper is comprised of two screw rods and two locking protrusions, the two screw rods rotatably insert through the two longitudinal holes of the base respectively, the two locking protrusions screw with the two screw rods individually so that when the two screw rods rotate, the two columns of the base limit upward rotation of the two screw rods, and the two locking protrusions engage with a part of the kitchen basin around the opening;

wherein the body includes a second anti-rotation portion adjacent to a bottom of an inner wall of the body, when the body is fitted with the support portion of the base, the second anti-rotation portion connects with the first anti-rotation portion of the base so that the body is stopped and does not rotate along the base; the body includes a threaded orifice formed on an outer wall thereof adjacent to a bottom of the body;

wherein the locking bolt screws with the threaded orifice of the body and abuts against the recessed portion of the base so that the body is stopped and does not move along the base, hence the body does not upwardly remove from the base.

2. The top mounting faucet assembly as claimed in claim 1, wherein the recessed portion of the base has a tilted face defined on an upper end of the peripheral fence.

3. The top mounting faucet assembly as claimed in claim 1, wherein the first anti-rotation portion has multiple toothed racks extending along the peripheral fence.

4. The top mounting faucet assembly as claimed in claim 3, wherein the second anti-rotation portion has multiple internal faces defined thereon and has a plurality of toothed slots formed on the second anti-rotation portion so that the multiple toothed racks mesh with the plurality of toothed slots respectively.

5. The top mounting faucet assembly as claimed in claim 4, wherein a vertical length of the first anti-rotation portion along the peripheral fence is less than a vertical length of the second anti-rotation portion.

6. The top mounting faucet assembly as claimed in claim 5, wherein the recessed portion of the base partially extends around the peripheral fence so that the multiple toothed racks of the first anti-rotation portion mesh with the plurality of toothed slots of the second anti-rotation portion respectively, and the locking bolt abuts against the recessed portion.

7. The top mounting faucet assembly as claimed in claim 1, wherein the first anti-rotation portion has multiple internal faces defined thereon and has a plurality of toothed slots formed on the first anti-rotation portion.

8. The top mounting faucet assembly as claimed in claim 7, wherein the second anti-rotation portion has multiple toothed racks extending along the peripheral fence.

9. The top mounting faucet assembly as claimed in claim 8, wherein a vertical length of the second anti-rotation portion along the peripheral fence is less than a vertical length of the first anti-rotation portion.

10. The top mounting faucet assembly as claimed in claim 9, wherein the recessed portion of the base partially extends around the peripheral fence so that the multiple toothed racks of the second anti-rotation portion mesh with the plurality of toothed slots of the first anti-rotation portion respectively, and the locking bolt abuts against the recessed portion.

11. The top mounting faucet assembly as claimed in claim 1, wherein the two columns of the base are integrally connected on the cylindrical fence.

12. The top mounting faucet assembly as claimed in claim 1, wherein the support portion of the base has a surrounding rib proximate to a bottom of an outer inner wall of the peripheral fence, and the body has a contacting fringe formed on the bottom of the inner wall thereof, such that when the body is secured on the base, the contacting fringe of the body matingly contacts with the surrounding rib.

13. The top mounting faucet assembly as claimed in claim 1, wherein the clamper includes two positioning bushings screwing with the two screw rods respectively so as to stop a removal of the two locking protrusions from the two screw rods.

14. The top mounting faucet assembly as claimed in claim 1, wherein the support portion of the base has a marking zone.

15. The top mounting faucet assembly as claimed in claim 1, wherein the cylindrical fence of the base has a first passage and a second passage which does not communicate with the first passage.

* * * * *